United States Patent [19]

Kettinger

[11] 4,412,915

[45] Nov. 1, 1983

[54] SPECIFIC GRAVITY RESPONSIVE CONTROL OF BMCI IN AROMATIC EXTRACT OILS

[75] Inventor: James G. Kettinger, Borger, Tex.

[73] Assignee: Phillips Petroleum Company, Bartlesville, Okla.

[21] Appl. No.: 300,148

[22] Filed: Sep. 8, 1981

[51] Int. Cl.[3] ..... C10G 21/30

[52] U.S. Cl. ..... 208/311; 208/338; 208/339

[58] Field of Search ..... 208/311, 322, 338, 339

[56] References Cited

U.S. PATENT DOCUMENTS

| | | | |
|---|---|---|---|
| 2,734,848 | 2/1956 | Myers | 196/14.2 |
| 2,777,800 | 1/1957 | Mitchell et al. | 196/14.47 |
| 2,855,362 | 10/1958 | Ratje et al. | 208/339 |
| 2,905,638 | 9/1959 | Hettick | 208/338 |
| 2,911,361 | 11/1959 | Kleiss | 208/311 |
| 2,990,366 | 6/1961 | Stone | 208/341 |
| 3,007,979 | 11/1961 | Peters | 260/674 |
| 3,251,767 | 5/1966 | Stewart | 208/311 |
| 3,285,846 | 11/1966 | King et al. | 208/28 |
| 3,317,423 | 5/1967 | Hebert | 208/327 |
| 3,530,042 | 9/1970 | Graybill et al. | 196/14.52 |

*Primary Examiner*—Winston A. Douglas
*Assistant Examiner*—William Leader

[57] ABSTRACT

A process for controlling the removal rate of an aromatic extract oil from a solvent recovery zone in response to the specific gravity of the aromatic extract oil product.

3 Claims, 3 Drawing Figures

F

SPECIFIC GRAVITY RESPONSIVE CONTROL OF BMCI IN AROMATIC EXTRACT OILS

This invention is related to a method for controlling the flow rate of an extract solution from a solvent extraction zone. More particularly, this invention relates to a method for producing an aromatic extract oil product of a preselected BMCI by controlling the rate of removal of the aromatic extract oil from a solvent extraction zone in response to the specific gravity (or API gravity) of the aromatic extract oil product.

BACKGROUND

Solvent refining is a well established processing tool for refiners and includes liquid-liquid extraction, solvent dewaxing, propane deasphalting, and modifications of these processes. Solvent refining is a petroleum fractionation procedure that deals with liquid phases of complex compositions and solubility equilibria under various conditions of temperature, mixing, concentration, and other factors.

Liquid-liquid solvent extraction has been practiced for almost 75 years. Liquid sulfur dioxide solvent has long been used to treat kerosene to recover a paraffin enriched raffinate and an aromatic enriched extract. Other well known solvents used in liquid-liquid solvent extraction include furfural, phenol and diethylene glycol. Some solvents can be modified with water to change their selectivities for certain components in the hydrocarbon feedstocks charged to the extraction process.

Catalytic cracking fractionation products, including such liquids as light cycle oil, heavy cycle oil and decant oil, are commonly subjected to solvent extraction processes. By contacting the catalytic cracking fractionation products with liquid sulfur dioxide solvent in a solvent extraction column, both a paraffin enriched raffinate and an aromatic enriched extract may be obtained. The aromatic extract has a high Bureau of Mines Correlation Index (BMCI) and is a desirable feedstock for oil furnace-type carbon black manufacture. As is known in the art, the more aromatic feedstocks produce more carbon black per gallon of feedstock and the carbon blacks produced have higher structure values than corresponding nodule-size carbon blacks produced from the less aromatic or lower BMCI oils. BMCI is defined as follows:

$$BMCI = \frac{48{,}640}{K} + 473.7G - 456.8 \qquad \text{(I)}$$

where

K=50% ASTM Boiling Point in °K. (°K.=°C.+273.1°)

G=Specific Gravity, 60° F./60° F.

In order to produce an aromatic extract oil product of a preselected BMCI value as feed for carbon black manufacture, it is necessary to control the solvent extraction process. Prior operations have used the level of extract solution in the solvent extraction tower to manipulate the rate of withdrawal of the aromatic extract phase. This phase is then charged to the solvent stripper or solvent recovery tower from which the extract oil product is yielded. This method does not give direct control over the BMCI of the aromatic extract oil product. It has been found that an aromatic extract oil product of a preselected BMCI can be produced by controlling the rate of removal of the aromatic extract phase from a solvent extraction zone in response to the specific gravity (or API gravity) of the aromatic extract oil product. If the BMCI of the aromatic extract oil product is too low, this will be reflected in terms of a low specific gravity product. By decreasing the aromatic extract oil removal rate the BMCI will increase. Similarly if the specific gravity is too high, indicating a higher than desired BMCI, the aromatic extract oil removal rate should be increased.

Accordingly, it is an object of this invention to produce an aromatic extract oil of a predetermined BMCI.

A further object of this invention is to provide a method for controlling the rate of removal of aromatic extract oil from a solvent extraction zone and in response to the specific gravity of the aromatic extract oil.

These and other objects will be made apparent from this disclosure of the invention and the appended claims.

DETAILED DESCRIPTION

Figure 2:
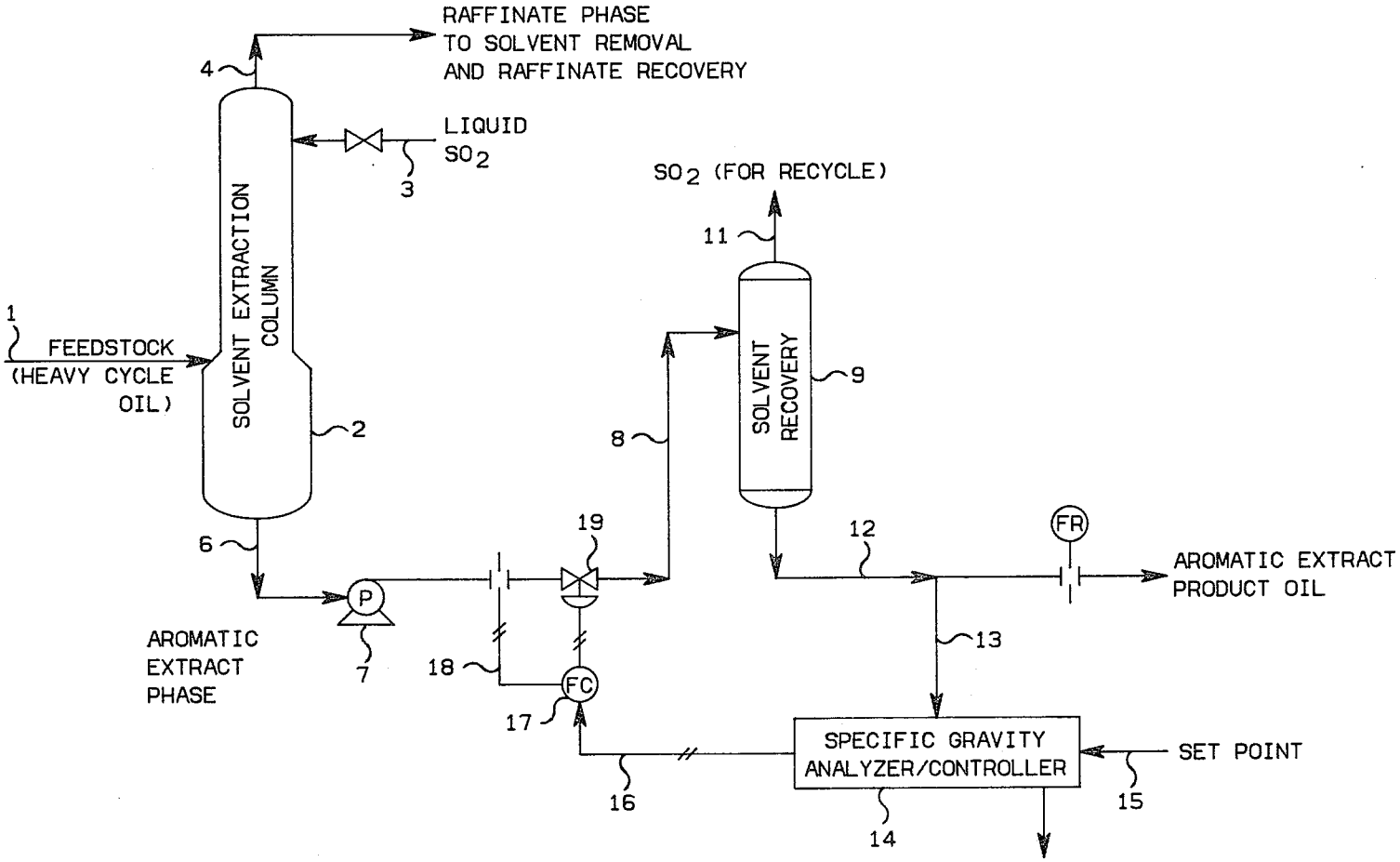
FIG. 2 is a schematic flow diagram of a liquid-liquid solvent extraction process.

In FIG. 2, feedstock 1, for example a heavy cycle oil, is charged to a conventional solvent extraction tower 2. Liquid $SO_2$ solvent is added to tower 2 at 3. The raffinate phase 4 is removed overhead and charged to a conventional solvent and product recovery zone not illustrated. The aromatic extract oil phase is removed from the tower 2 at 6 and pumped by 7 through conduit 8 to a conventional solvent recovery tower 9. $SO_2$ is removed at 11 for recovery and recycle to tower 2.

Aromatic extract oil product is removed from tower 9 by way of conduit 12 and is available as a feestock for carbon black manufacture. A sample stream of the aromatic extract oil is diverted from conduit 12 and passed through conduit 13 to a conventional specific gravity analyzer/controller 14. The analyzer/controller 14 regulates the flow of the extract phase 6 from tower 2 by means of a signal 16 to a flow controller 17 which in turn manipulates valve 19. The flow controller 17 receives a signal 18 which is representative of the actual flow.

Figure 3:
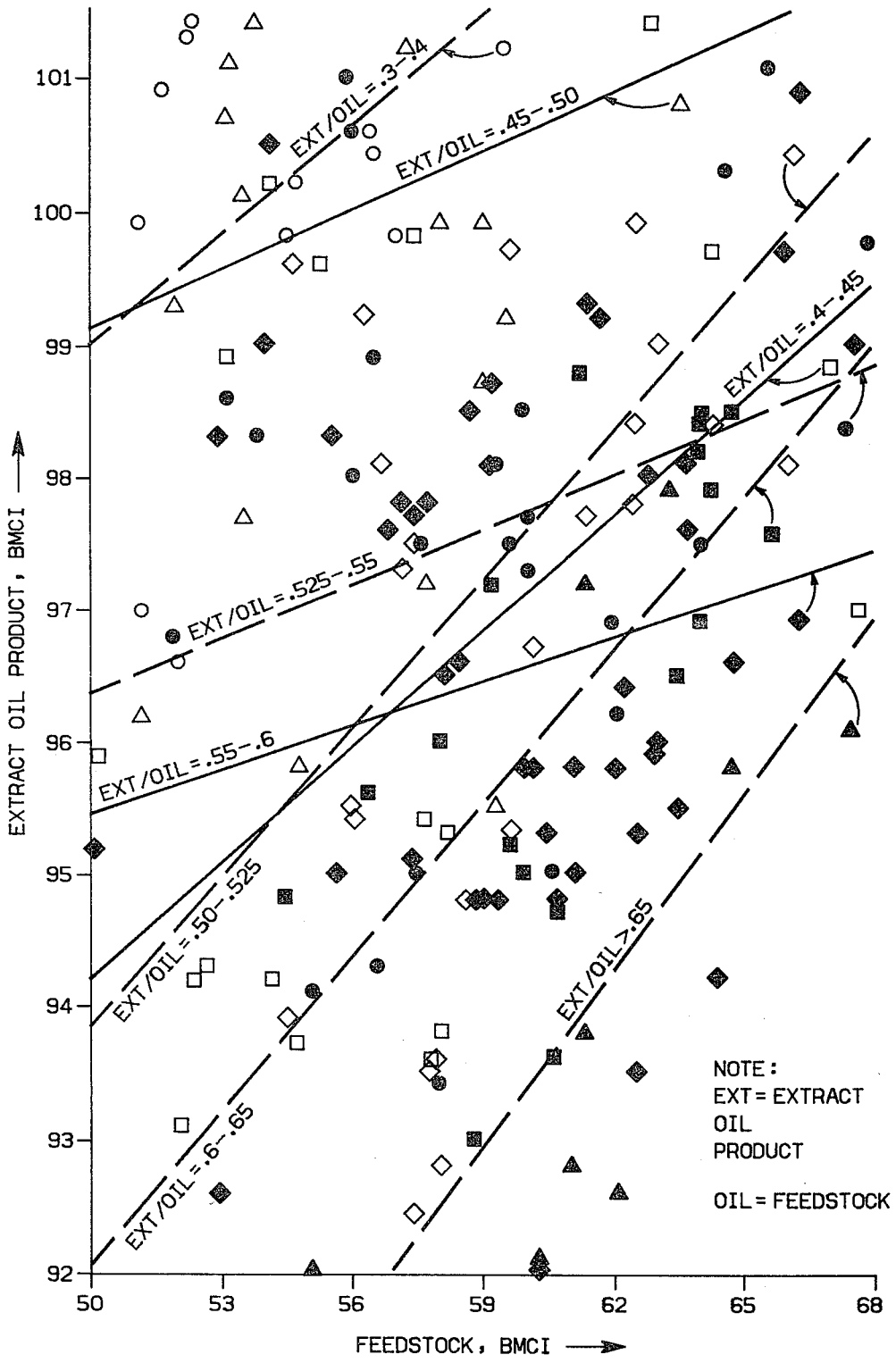
FIG. 3 is a graph relating extract BMCI to feedstock BMCI, at constant extract oil product to feedstock volume ratios.

This invention contemplates the use of a specific gravity analyzer/controller to keep constant the specific gravity of the aromatic extract oil product and thereby maintain the BMCI of that product at a preselected value. The specific gravity to be used as the set point 15 can be calculated using equation (I) from a lab determined 50% ASTM boiling point and the preselected BMCI. If during operation the specific gravity of the aromatic extract oil product varies from the set point, the specific gravity analyzer/controller will effect a corrective change in aromatic extract oil removal rate. An increase in removal rate results in both a lower BMCI and a lower specific gravity. A decrease in removal rate increases the BMCI and specific gravity. FIG. 3 demonstrates this relationship between removal rate and BMCI. From equation (I) and FIG. 1 it follows that, at constant 50% boiling point, BMCI increases linearly with increased specific gravity.

Specific gravity, rather than 50% boiling point, has been chosen as the control variable because BMCI is more sensitive to specific gravity than to 50% boiling point. This has been shown from a study of Phillips Petroleum Company's operation at Borger, Texas. Over a nine month period it was found that the specific gravity G of aromatic extract oil ranged from $G_1$ of 0.9806 to $G_2$ of 1.0246. The effect on BMCI at a constant 50% boiling point was calculated as follows:

$$\begin{aligned} BMCI &= 473.7G_2 - 473.7G_1 \\ &= 473.7(1.0246) - 473.7(.9806) \\ &= 20.85 \end{aligned}$$

It was also found in the same study that the 50% boiling point of the aromatic extract oil ranged from 640°-744° F. or 611°-669° K. ($K_1$=611° K.; $K_2$=669° K.). The effect on BMCI at a constant specific gravity was calculated as follows:

$$\begin{aligned} BMCI &= \frac{48640}{°K_1} - \frac{48640}{°K_2} \\ &= \frac{48640}{611} - \frac{48640}{669} \\ &= 6.90 \end{aligned}$$

The conclusion drawn from the study is that the effect of specific gravity on BMCI is dominant.

Figure 1:
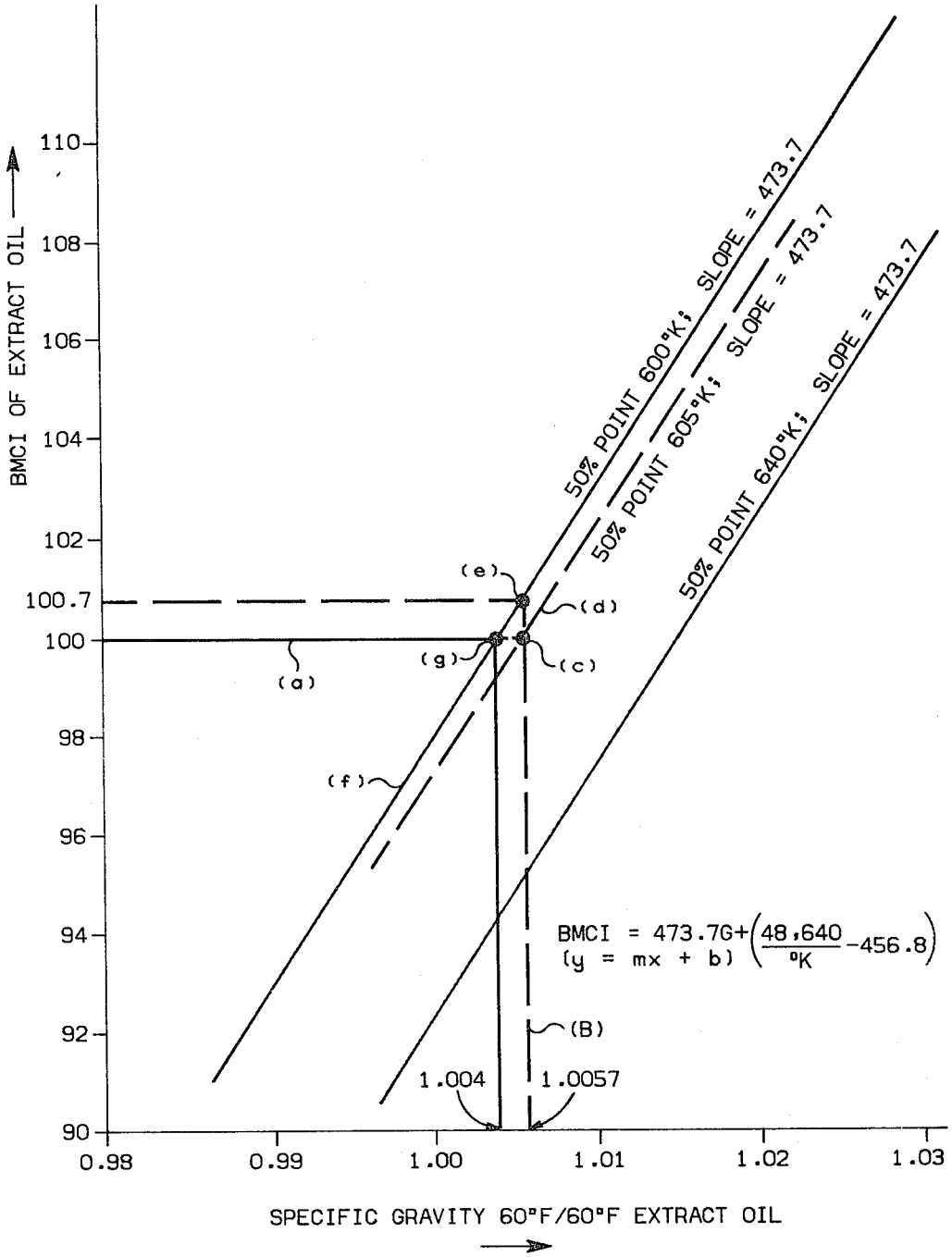
FIG. 1 is a graph relating specific gravity to BMCI.

The graph in FIG. 1 relates specific gravity to BMCI of extract oil. The plotted lines represent constant 50% (ASTM) boiling point °K. lines.

Normally the 50% boiling point of a feedstock such as light cycle oil, heavy cycle oil or decant oils recovered from the fractionation of catalytically cracked hydrocarbons, is about 10°-20° F. higher than the 50% boiling point of the aromatic extract oil product. To begin the solvent extraction process, the 50% boiling point is determined (using any conventional means) and the 50% boiling point of the extract product is estimated to be 10° F. below that value. For example, if the 50% boiling point of the feedstock was found to be 640° F. (611° K.) the estimated 50% boiling point of the aromatic extract oil would be 630° F. (605° K.).

The next step is to calculate the specific gravity by utilizing equation (I) which can be rearranged as:

$$G = \frac{\left(BMCI + 456.8 - \frac{48,640}{K}\right)}{473.7} \quad \text{(II)}$$

If a 100 BMCI aromatic extract oil is desired, the specific gravity, at 630° F. (605° K.) is calculated to be 1.0057. The specific gravity analyzer/controller is then set at this estimated set point (i.e. 1.0057).

The constant 50% boiling lines of FIG. 1 were prepared from equation I which, for a constant K, yields a straight line. Rearranged, equation I becomes $$BMCI = 473.7G + \frac{48,640}{K} - 456.8 \quad \text{(III)}$$

The slope of each constant 50% boiling line is 473.7 and the "y"-axis intercept is $$\frac{48,640}{K} - 456.8.$$

Continuing with the example and referring to FIG. 1, line a (BMCI=100) and line b (specific gravity=1.0057) are seen to meet at point c which must therefore be a point on the 50% boiling point line for K=605° K. (630° F.). Using the slope or the "y"-axis intercept, that line, shown by d, can be drawn.

With the specific gravity analyzer/controller set at the estimated set point (1.0057) the operation begins. The actual 50% boiling point of the aromatic extract oil product recovered at 12 is determined. If the actual 50% boiling point is different from the estimated 50% boiling point then the set point for the specific gravity analyzer/controller should be recalculated. Assume in the example that the actual 50% boiling point was found to be 621° F. (600° K.). Using equation III a constant 50% boiling point line for 600° K. (621° F.) is drawn (Y intercept is −375.73; slope is 473.7). It can be seen at point e, where lines b and f intersect, that under the present conditions the aromatic extract oil has an actual BMCI of 100.7, at G set point of 1.0057. Since the actual BMCI is greater than 100 (the desired BMCI value) the removal rate of aromatic extract from the solvent extraction zone should be increased. If the actual BMCI was lower than desired, the removal rate would be decreased.

To initiate the increase or decrease in removal rate a new specific gravity set point, more closely aligned with the desired results, is determined. Line a (100 BMCI) and line f (constant 50% boiling point line for 600° K.) intersect at point g and indicate a specific gravity of 1.004. The same result can be calculated from equation II. The new set point (1.004 in the example) results in a signal 16 from the specific gravity analyzer/controller 14 to the flow controller 17 which adjusts (increases in this case) the aromatic extract removal rate.

After further operation the aromatic extract oil product may be anazlyzed again to determine its actual 50% boiling point. Any necessary adjustment to the specific gravity set point may be made in accordance with the above-outlined procedure.

For each given set point and until such set point is changed, the specific gravity analyzer/controller maintains a constant BMCI for the aromatic extract oil product by adjusting the removal rate in response to any variation in specific gravity.

Reasonable variation and modification of this invention as set forth herein, not departing from the essence and spirit of my disclosure, are contemplated and intended to be encompassed within the scope of the appended claims. Examples have been given only by way of illustration and should not be interpreted as limiting or further defining the invention other than as set forth in the appended claims.

I claim:

1. In a solvent extraction process a method for maintaining a constant BMCI for an aromatic extract oil which comprises controlling the removal rate of the aromatic extract oil from a solvent extraction zone in response to the specific gravity of the aromatic extract oil removed from said solvent extraction zone.

2. A method in accordance with claim 1 wherein the specific gravity of the aromatic extract oil is determined after the aromatic extract oil has passed through a solvent recovery zone.

3. A method in accordance with claim 1 wherein a specific gravity analyzer/controller is used to measure the specific gravity of the aromatic extract oil and to control the flow rate of aromatic extract oil from the solvent extraction zone.

* * * * *